US008419462B2

(12) United States Patent
Tanaka et al.

(10) Patent No.: US 8,419,462 B2
(45) Date of Patent: Apr. 16, 2013

(54) LEVER TYPE CONNECTOR

(75) Inventors: Shinya Tanaka, Makinohara (JP); Akihiro Tsuruta, Fujieda (JP); Kazuya Terao, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/196,032

(22) Filed: Aug. 2, 2011

(65) Prior Publication Data

US 2012/0034812 A1 Feb. 9, 2012

(30) Foreign Application Priority Data

Aug. 5, 2010 (JP) ..... 2010-176212

(51) Int. Cl.
*H01R 13/62* (2006.01)

(52) U.S. Cl.
USPC ..... 439/372; 439/157

(58) Field of Classification Search ..... 439/372, 439/157, 153, 160
See application file for complete search history.

(56) References Cited

U.S. PATENT DOCUMENTS 5,230,635 A 7/1993 Takenouchi et al.
6,164,992 A * 12/2000 Okabe ..... 439/157
6,183,277 B1 * 2/2001 Okabe et al. ..... 439/157
6,247,945 B1 * 6/2001 Wakui et al. ..... 439/157
6,619,978 B2 * 9/2003 Okabe et al. ..... 439/372
7,578,685 B2 * 8/2009 Matsumura et al. ..... 439/157
2002/0182918 A1 12/2002 Okabe et al.

FOREIGN PATENT DOCUMENTS

JP 5-3059 A 1/1993
JP 2002-359028 A 12/2002

* cited by examiner

*Primary Examiner* — Renee Luebke
*Assistant Examiner* — Harshad Patel
(74) *Attorney, Agent, or Firm* — Sughrue Mion, PLLC

(57) ABSTRACT

A lever in a lever type connector which is attached to a first housing, is rotated to fit the first housing to a second housing, and has a pair of side walls and an operation potion connecting the side walls. Locking arms are provided on the side walls so as to project toward an opening of the first housing into which the second housing is fitted. Temporary locking releasing portions are provided in the first housing. The locking arms are deformed into a state that a part of each of the locking arms is disposed on each of the temporary locking releasing portions, so that the lever is elastically deformed, when the lever is rotated. Each of the temporary locking releasing portions has an inclined face on which each of the locking arms is moved in a direction which the lever is elastically restored after the locking arms are deformed by the temporary locking releasing portions.

3 Claims, 9 Drawing Sheets

11
13
15
17
25
31
39
53
55
59
61
63
65
F

LEVER TYPE CONNECTOR

BACKGROUND

The present invention relates to a lever type connector which implements the fitting of a pair of male and female connector parts by making use of a low insertion force.

Japanese Patent Publication No. 2002-359028 A discloses a lever type connector, which includes, as is shown in FIG. 8, a male housing 501, a lever 503 rotatable with respect to the male housing 501, a connecting portion 505 for connecting the lever 503 to the male housing 501, and a female housing 507 in which the male housing 501 is fitted for accommodation therein. The connecting portion 505 includes a projecting portion 509 which is provided on the male housing 501 and an engagement hole 511 which is provided in the lever 503 so as to be brought into engagement with the projecting portion 509 and which is formed to extend long towards one side of the lever 503 with respect to the projecting portion 509. The lever 503 is allowed to be displaced to an opposite position to a fitting position in such a state that the male and female housings 501, 507 are fitted together in a normal condition.

In this lever type connector 500, the lever 503 is displaced to the other side of the lever 503 to the fitting position where the male and female housings are fitted together in the normal condition. This configuration solves the problem inherent in a conventional lever type connector that the force pressing down directly the male housing 501 lacks a force corresponding to the component force acting in a direction which intersects the male housing 501 in the vertical direction.

SUMMARY

The conventional lever type connector disclosed in Japanese Patent Publication No. 2002-359028 A solves the problem that the force pressing downwards directly the male housing lacks the component force acting in the vertical direction and manages to increase the workability in fitting the male and female housing together. However, while the reduction in size and weight still continues to be demanded for this type of lever type connectors, there is a high demand for a further reduction in insertion force.

In addition to the conventional example described above, Japanese Patent Publication No. 5-3059A discloses a lever type connector. As is shown in FIG. 9, this lever type connector 520 includes a lever member 523 and an elastic lock member 531. The lever member 523 is supported rotatably on a female connector part. The elastic lock member 531 has a spring lock portion 525, lock releasing portions 527 and elastic engagement portions 529. The elastic lock member 531 is assembled along the lever member 523 and biases the lever member 523 in a lock releasing direction. In an initial fitting stage of two connector parts, cam pins 535 are brought into engagement with corresponding cam grooves 533. In a final fitting stage of both the two connector parts by the rotation of the lever member 523, the spring lock portion 525 is brought into engagement with the lock portion 537. In an intermediate fitting stage of the two connector parts, the elastic engagement portions 529 of the elastic lock member 531 ride over corresponding angular spring guides 539 to thereby reduce the fitting load by making use of a restoring force generated in the elastic engagement portions 529 when the elastic engagement portions 529 ride over the spring guides 539.

However, in order to make use of the restoring force generated in the elastic engagement portions 529, the separate elastic lock member 531 has to be installed on the lever member 523, which is disadvantageous in reducing the size and weight of the lever type connector.

It is therefore one advantageous aspect of the present invention to provide a lever type connector which is advantageous in reducing the size and weight thereof and which can realize a reduction in insertion force.

According to one advantage of the invention, there is provided a lever type connector comprising;

a first housing;

a second housing;

a lever, attached to the first housing, configured to be rotated to fit the first housing to the second housing, and having a pair of side walls and an operation potion connecting the side walls;

locking arms, provided on the side walls so as to project toward an opening of the first housing into which the second housing is fitted; and temporary locking releasing portions, provided in the first housing;

wherein the locking arms are deformed into a state that a part of each of the locking arms is disposed on each of the temporary locking releasing portions, so that the lever is elastically deformed, when the lever is rotated, and wherein each of the temporary locking releasing portions has an inclined face on which each of the locking arms is moved in a direction which the lever is elastically restored after the locking arms are deformed by the temporary locking releasing portions.

The lever type connector may further comprise temporary locking projections, provided in the second housing. The locking arms may be engaged to the temporary locking projections so that the lever is prevented from being rotated so as to be held at temporary locking positions.

The lock arms may be deformed in a direction in which the pair of the side walls are spaced away from each other.

DETAILED DESCRIPTION OF EXEMPLIFIED EMBODIMENTS

Hereinafter, an embodiment of the invention will be described by reference to the drawings.

Figure 1:
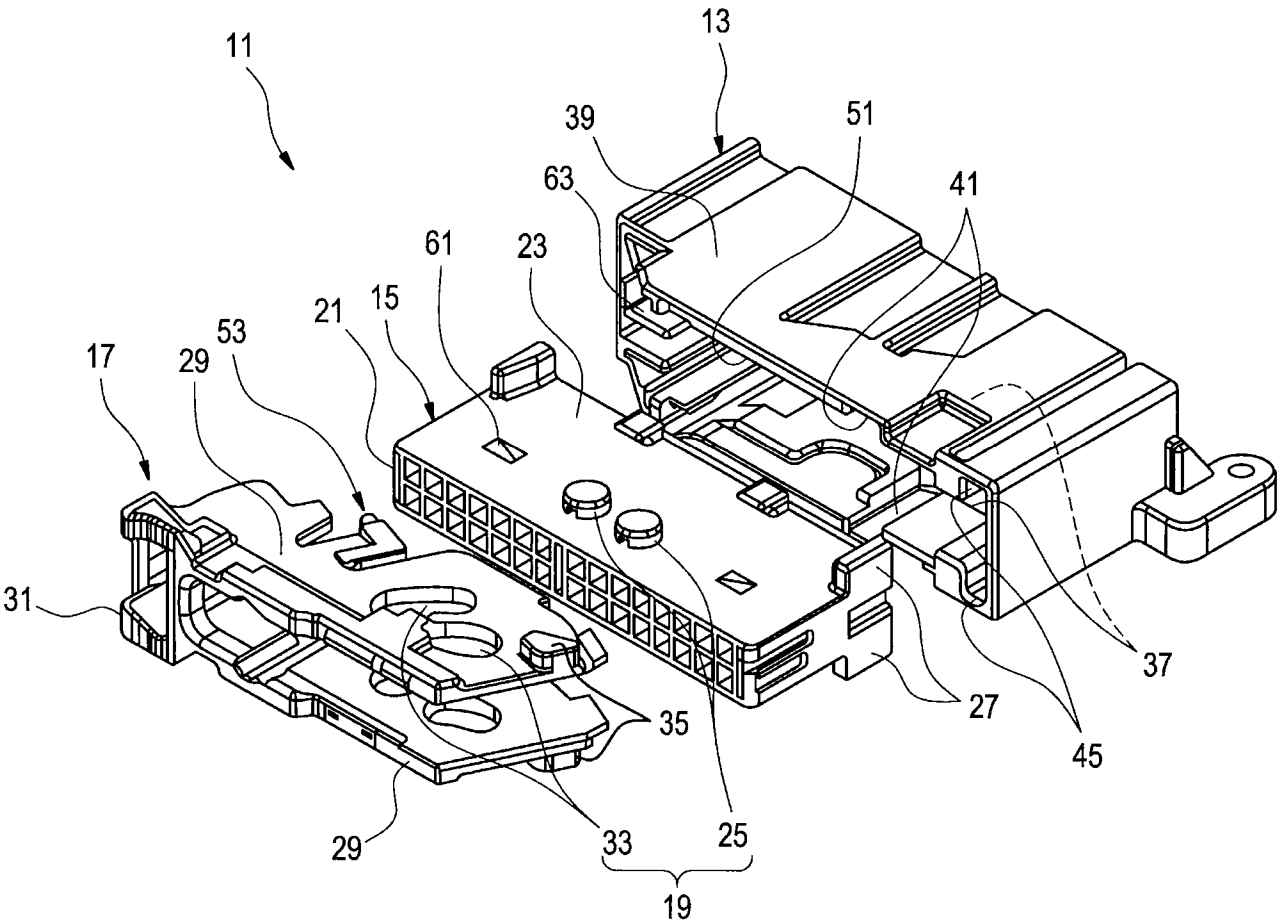
FIG. 1 is an exploded perspective view of a lever type connector according to the invention.
Figure 2:
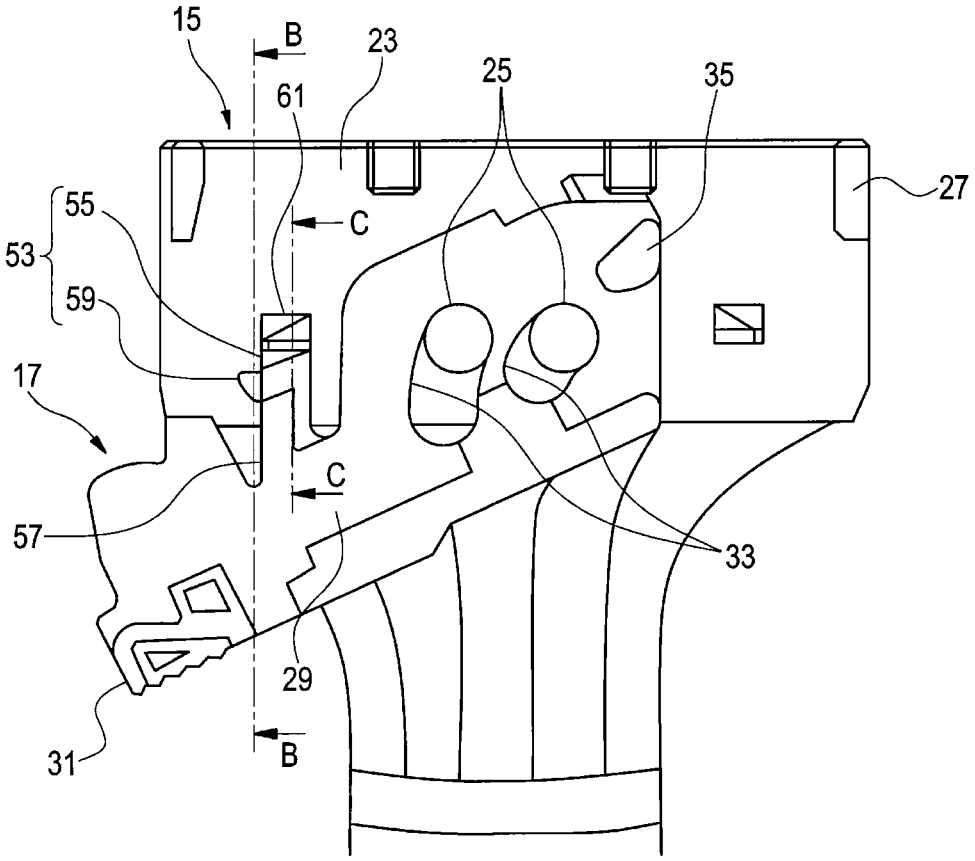
FIG. 2 is a plan view of a female connector part on which a lever is installed.
Figure 3:
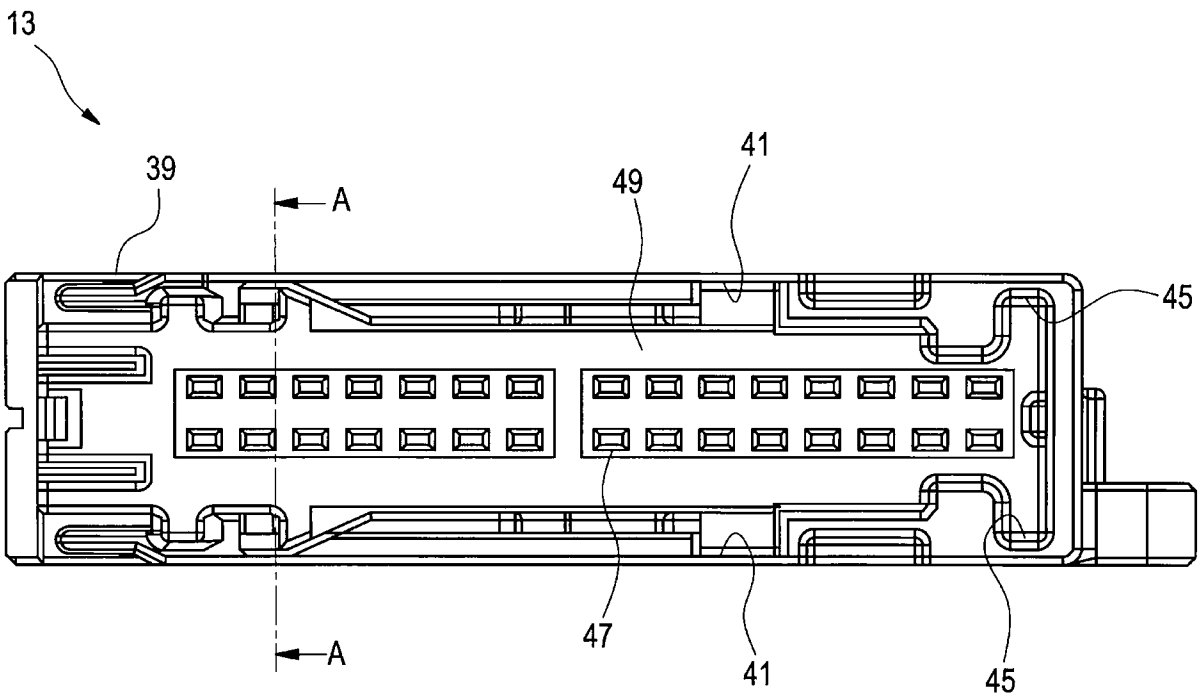
FIG. 3 is a front view of a male connector part showing a fitting opening portion.
Figure 4:
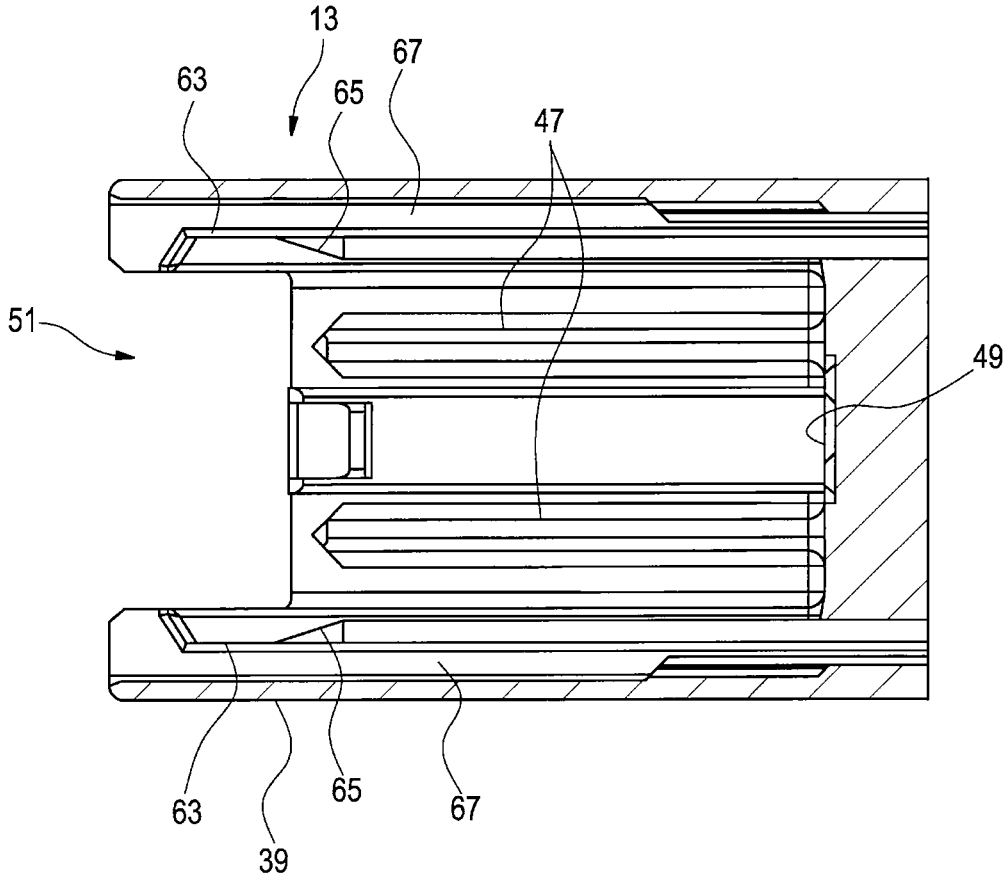
FIG. 4 is a sectional view taken along the line A-A in FIG. 3.

FIG. 1 is an exploded perspective view of a lever type connector according to the invention, FIG. 2 is a plan view of a female connector part on which a lever is installed, FIG. 3 is a front view of a male connector part showing a fitting opening portion, and FIG. 4 is a sectional view taken along the line A-A in FIG. 3.

A lever type connector 11 includes a male housing 13 which is a first housing, a female housing 15 which is a second housing which is fitted in the male housing 13 to be accommodated therein, a lever 17 which is rotatably installed on the female housing 15 and a connecting portion 19 for connecting the lever 17 to the female housing 15. In this embodiment, although the first housing is the male housing 13 and the second housing is the female housing 15, the lever type connector 11 may be such that the first housing is the female housing 15 and the second housing is the male housing 13.

In the lever type connector 11, the lever 17 which is to be brought into engagement with the male housing 13 is installed rotatably on the female housing 15, and when the male housing 13 and the female housing 15 are inserted one in the other so as to be fitted together, the lever 17 is rotated so as to reduce an inserting force by making use of leverage generated by the lever 17.

The female housing 15 has a plurality of terminal accommodation compartments 21 in which female terminals are accommodated individually. A pair of projecting portions 25 are provided on each of both larger side surfaces 23 of the female housing 15 so as to project therefrom. In addition, guide ribs 27 are formed individually at one end sides of both the side surfaces 23 in a longitudinal direction so as to project from the corresponding side surfaces 23 along a vertical direction.

The lever 17 includes a pair of side walls 29 which are disposed so as to face each other with both the side faces 23 of the female housing 15 held therebetween and an operating portion 31 which connects together one end sides of the side walls 29 in a longitudinal direction. A pair of engagement holes 33 are provided on each of the side walls 29 so as to be brought into engagement with the corresponding pair of projecting portions 25 on each of the side surfaces of the female housing 15. An engagement projection 35 is provided on each of the side walls 29 at an opposite side to the side which is connected by the operating portion 31 across the engagement holes 33. This engagement projection 35 is locked on a locking step portion 37 formed in an interior of the male housing 13.

The connecting portion 19 is made up of the projecting portions 25 formed on the female housing 15 and the engagement holes 33 provided in the lever 17. As is shown in FIG. 2, the connecting portion 19 is configured so that the projecting portions 25 and the engagement holes 33 are brought into engagement with each other and the side walls 29 of the lever 17 are connected to the female housing 15, so that the lever 17 is allowed to rotate about the projecting portions 25 as an rotational axis.

The male housing 13 has a hood portion 39 into which the female housing 15 is fitted. This hood portion 39 has engagement grooves 41 which are provided on an inner circumferential surface in positions which correspond to the engagement projections 35 on the lever 17 so as to extend along the vertical direction. The engagement grooves 41 in the hood portion 39 have the locking step portions 37 with which the engagement projections 35 are brought into engagement and which constitute fulcrums together with the engagement projections 35 when the lever 17 rotates. In addition, the hood portion 39 has guide grooves 45 which are formed in the inner circumferential surface in positions which correspond to the guide ribs 27 on the female housing 15 so that the guide ribs 27 are inserted thereinto. As is shown in FIG. 3, the hood portion 39 has a plurality of mating terminals 47 which are provided on a bottom surface 49 so as to project therefrom for connection to the terminals of the female housing 15.

Incidentally, as is shown in FIG. 2, locking arms 53 are provided on the side walls 29 of the lever 17 so as to project towards the fitting opening portion 51 in the male housing 13. The locking arm 53 is made up of a strip piece portion 55 and a projecting piece portion 59 which projects from one side portion 57 of the strip piece portion 55. Temporary locking projections 61 are provided on the female housing 15 which prevent the rotation of the lever 17 and hold the lever 17 in a temporary locking position. As is shown in FIG. 2, the locking arm 53 temporarily locks the lever 17 by causing the strip piece portion 55 to be locked on the temporary locking projection 61.

As is shown in FIG. 4, a pair of temporary locking releasing portions 63 are provided within the hood portion 39 of the male housing 13 on which the locking arms 53 ride while elastically deforming the lever 17 when the lever 17 rotates. Inclined surfaces 65 are formed on the temporary locking releasing portions 63. The inclined surfaces 65 allow the locking arms 53 to slide downwards therealong in a direction in which the lever 17 is elastically restored when the lever 17 rotates to such an extent to trigger an inserting force reducing operation. Gap portions 67 are defined between the temporary locking releasing portions 63 and the hood portion 39 so that the locking arms 53 enter them. Consequently, when the locking arms 53 ride on the temporary locking releasing portions 63, the lever 17 is elastically deformed in a direction in which the pair of side walls 29 are spaced away from each other.

Next, the function of the lever type connector 11 will be described which is configured as has been described above.

Figure 6A:
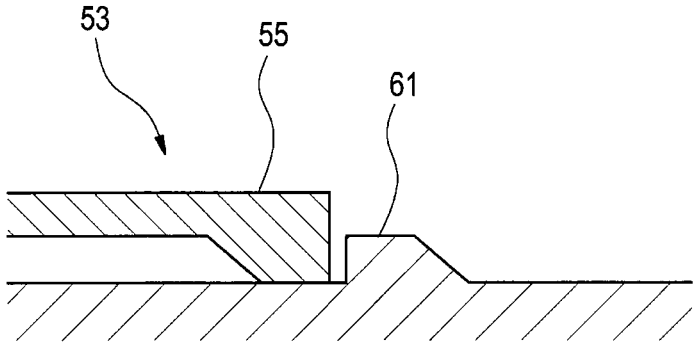
FIGS. 6A to 6C are operation explanatory diagrams showing the fitting stages at a portion taken along the line B-B and seen in a direction indicated by arrows B, B in FIG. 2.
Figure 6B:
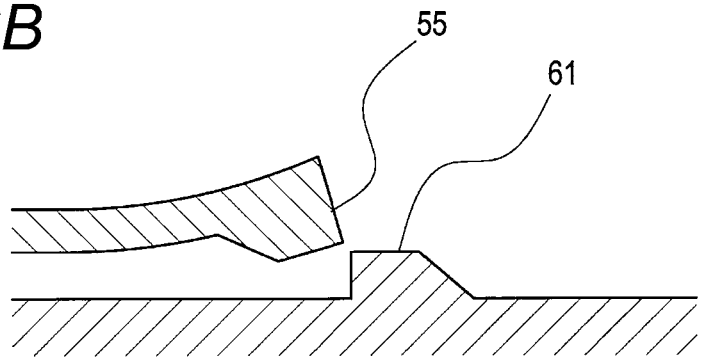
Figure 6C:
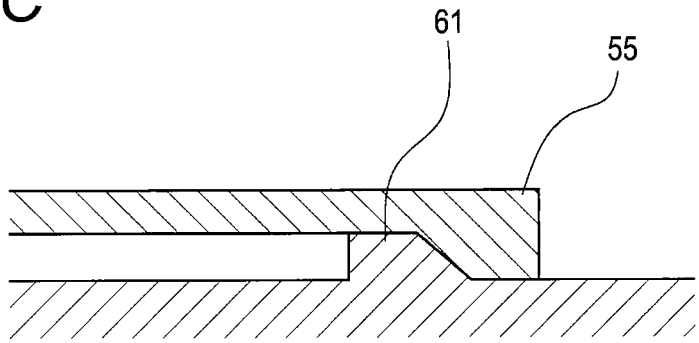
Figure 7A:
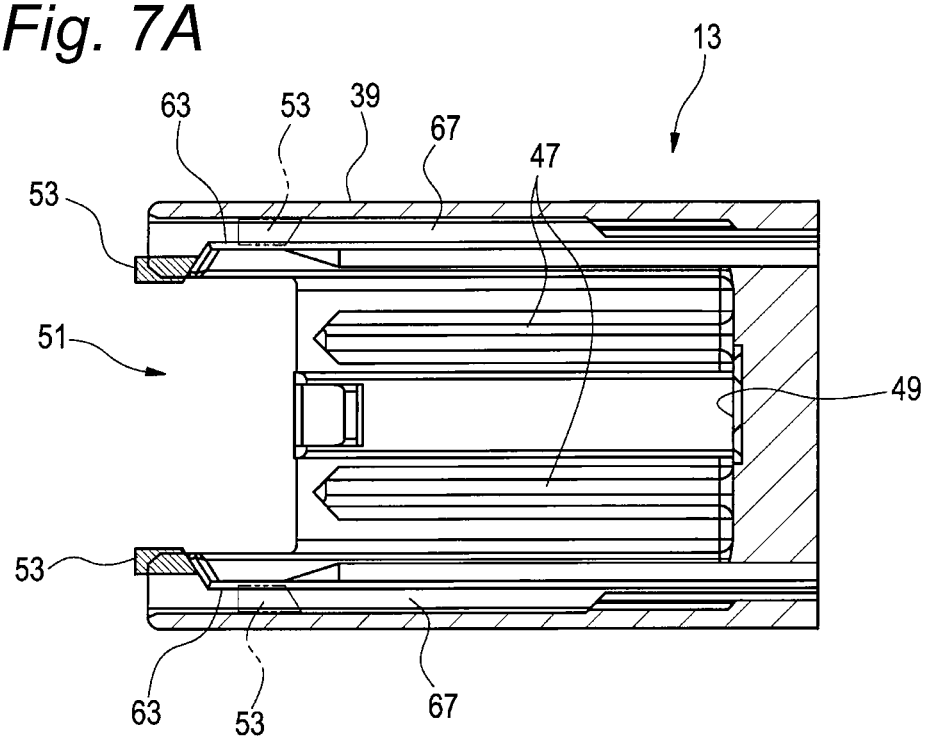
FIGS. 7A and 7B are operation explanatory diagrams showing the fitting stages at a portion taken along the line C-C and seen in a direction indicated by arrows C, C in FIG. 2.
Figure 7B:
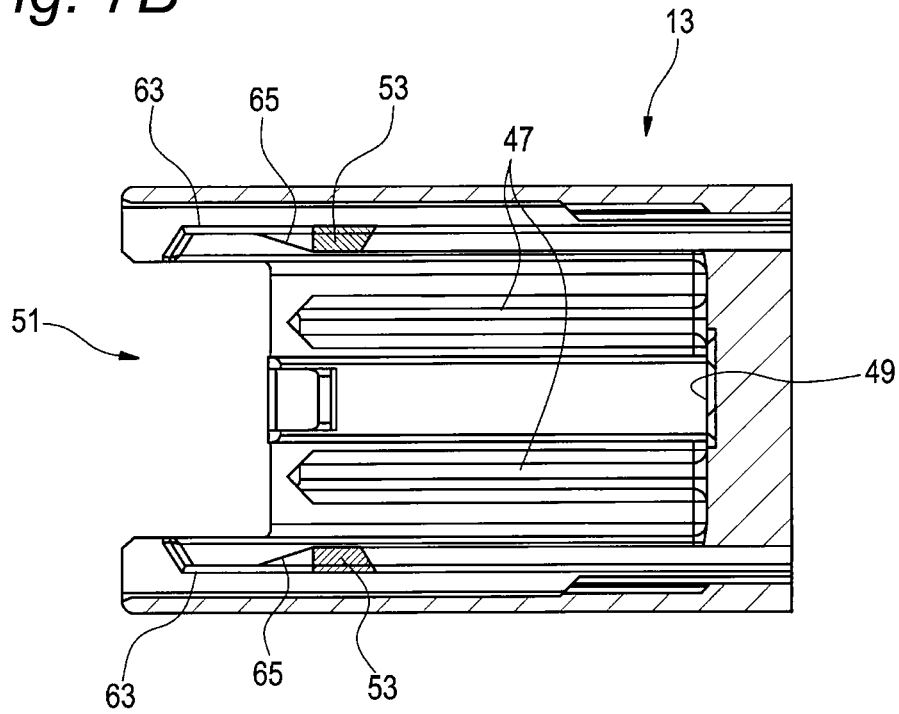
Figure 8:
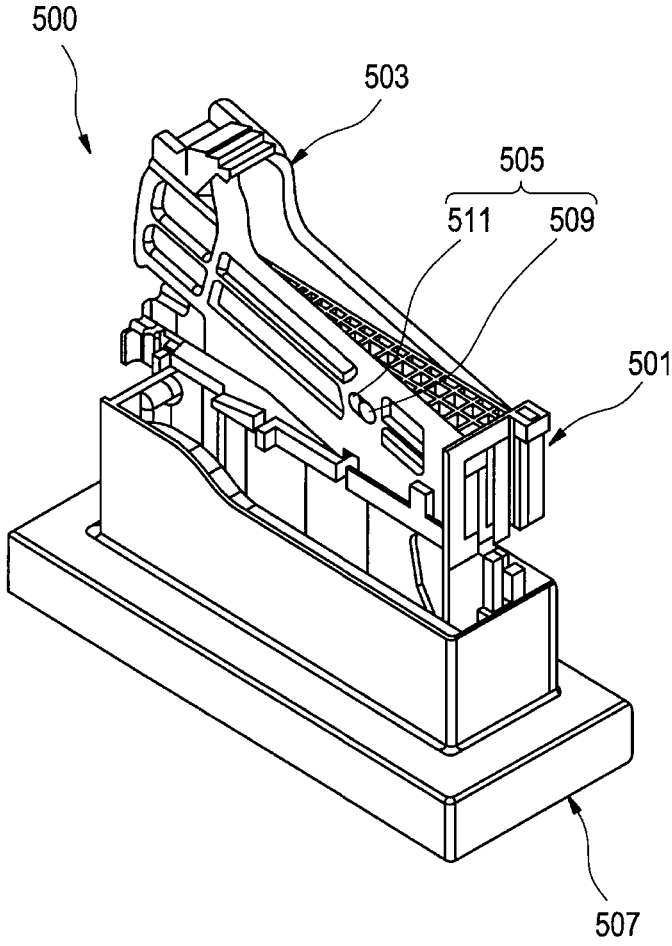
FIG. 8 is a perspective view of a conventional lever type connector before connector parts are fitted together.
Figure 9:
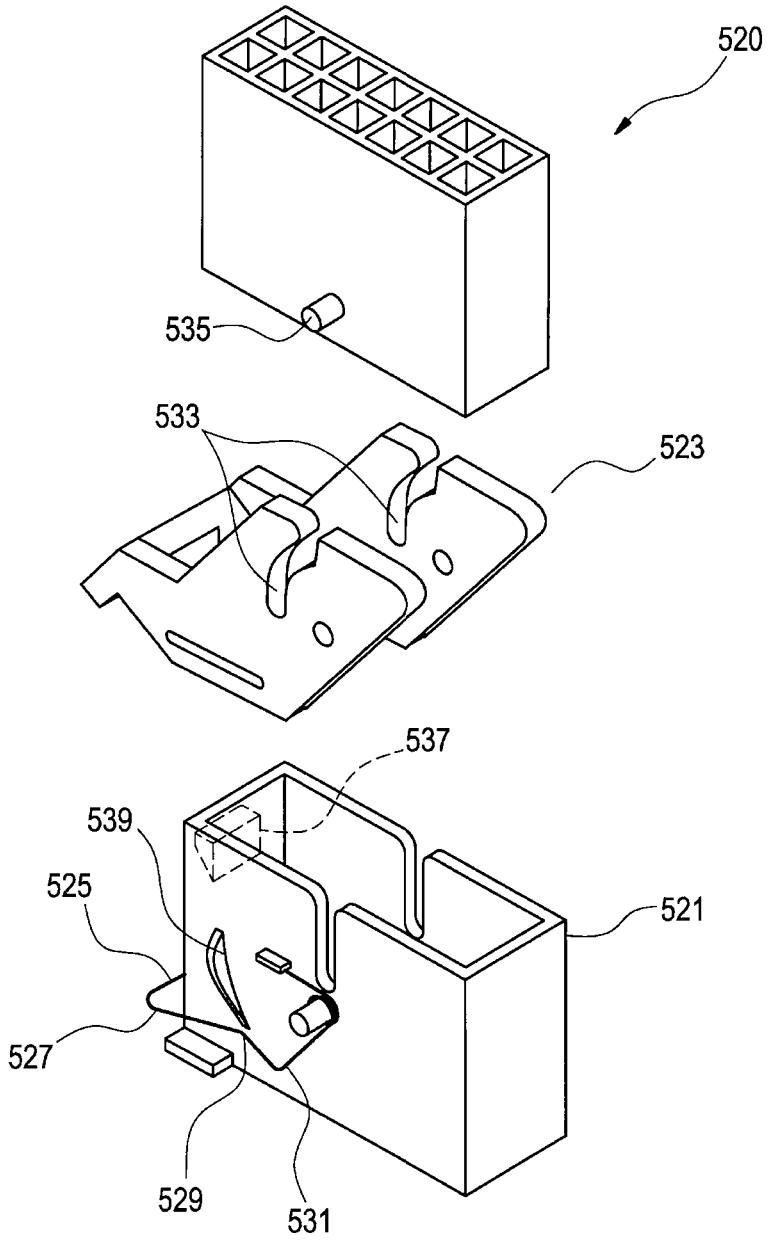
FIG. 9 is an exploded perspective view of another conventional lever type connector.

FIGS. 5A to 5D are operation explanatory diagrams showing fitting stages of the lever type connector 11. FIGS. 6A to 6C are operation explanatory diagrams showing the fitting stages at a portion taken along the line B-B and seen in a direction indicated by arrows B, B in FIG. 2. FIGS. 7A and 7B are operation explanatory diagrams showing the fitting stages at a portion taken along the line C-C and seen in a direction indicated by arrows C, C in FIG. 2.

Figures 5A, 5B, 5C, 5D:
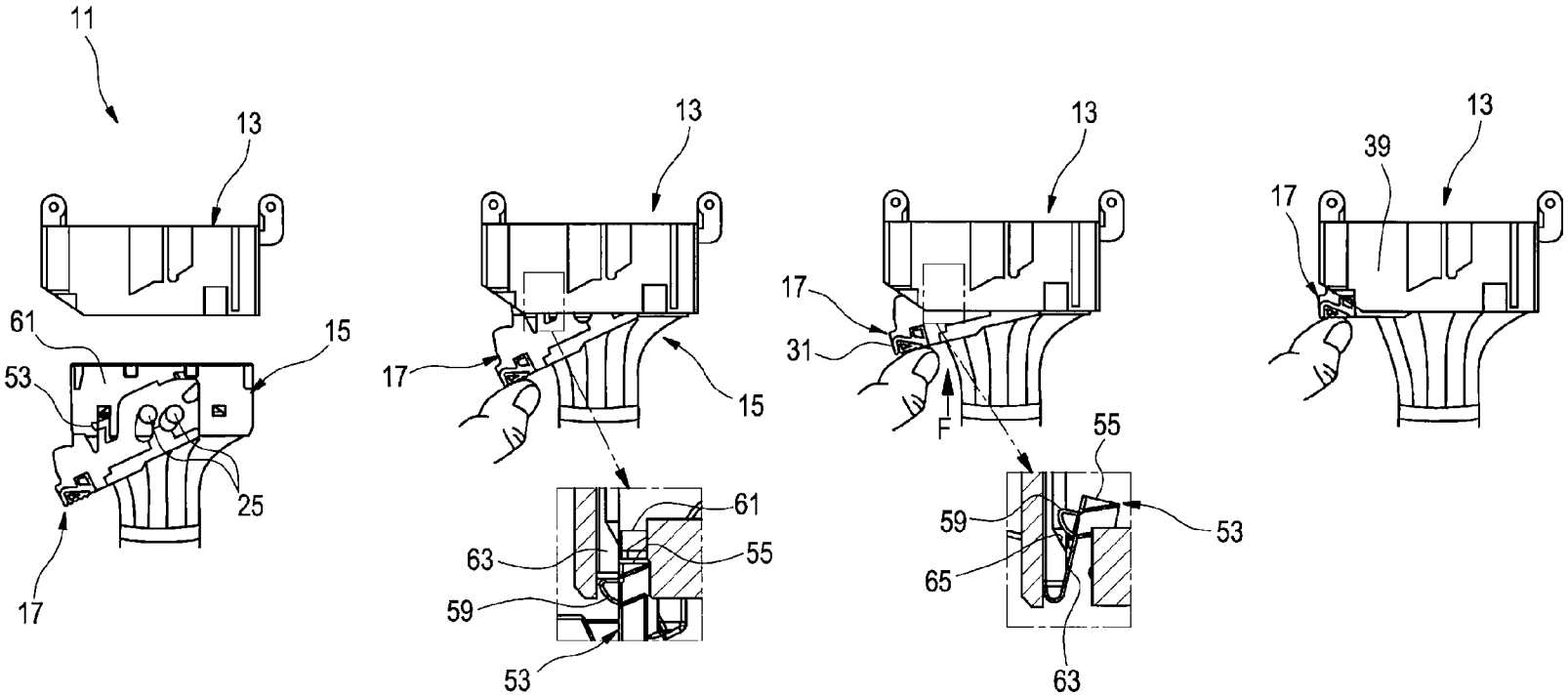
FIGS. 5A to 5D are operation explanatory diagrams showing fitting stages of the lever type connector.

As is shown in FIG. 5A, in the lever type connector 11, the female housing 15 on which the lever 17 is installed is fitted into the male housing 13. As this occurs, the locking arms 53 are brought into abutment with the temporary locking projections 61 as is shown in FIG. 6A, whereby the lever 17 is prevented from rotating further.

When the female housing 15 and the male housing 13 are fitted together, as is shown in FIG. 5B, the engagement projections 35 of the lever 17 (refer to FIG. 2) are brought into engagement with the locking step portions 37 of the engagement grooves 41 (refer to FIG. 1) of the male housing 13 so as to make them function as fulcrums. Then, as is shown in FIG. 5C, the operating portion 31 of the lever 17 is pressed so as to rotate the lever 17 in the fitting direction of the female housing 15 and the male housing 13. As this occurs, a force is exerted on the projecting portions 25 by leverage generated in the lever 17 rotated and the pressing force which presses against the operating portion 31 so as to press downwards directly the female housing 15, whereby the female housing 15 shifts in whole in the fitting direction. As a result, as is shown in FIG. 5D, the female housing 15 is fitted in the hood portion 39 of the male housing 13. In this state, the lever 17 is accommodated in the hood portion 39 of the male housing 13 together with the female housing 15.

Incidentally, as is shown in FIG. 5B, when the male housing 13 and the female housing 15 start to be fitted together, the locking arms 53 of the lever 17 which is installed on the female housing 15 are brought into abutment with the temporary locking releasing portions 63 of the male housing 13. In the locking arms 53, as is shown in FIG. 6A, although a distal end of the strip piece portion 55 is in abutment with the temporary locking projection 61, the projecting piece portion 59 which projects from the one side portion 57 of the strip piece portion 55 is brought into abutment with the temporary locking releasing portion 63.

When the lever 17 is rotated in the operating direction, as is indicated by double-dashed lines in FIG. 7A, the locking arms 53 ride on the temporary locking releasing portions 63, and the lever 17 is elastically deformed correspondingly to the riding of the locking arms 53 on the temporary locking releasing portions 63. The locking arms 53 release the locking of the strip piece portions 55 with the temporary locking projections 63 as is shown in FIG. 6B by the deformation produced when the projecting piece portions 59 ride on the temporary locking releasing portions 63. Namely, the pushing biasing force of the lever 17 is designed to be obtained by making effective use of the temporary locking construction which temporarily locks and releases the lever 17. In addition, in this embodiment, the elastic deformation of the lever which generates the pushing biasing force of the lever 17 is the deformation in the direction in which the pair of side walls 29 are spaced away from each other. By this configuration, the locking of the locking arms 53 on the temporary locking projections 61 can be released at the same time as the deformation.

As is shown in FIG. 5C, when the lever 17 rotates further in the operating direction, the locking arms 53 which are now on the temporary locking releasing portions 63 reach the inclined surfaces 65 thereof. Then, as shown in FIG. 7B, the locking arms 53 slide downwards along the inclined surfaces 65 by an elastic restoring force of the lever 17. As this occurs, at the same time as this, the strip piece portions 55 also ride over the temporary locking projections 61 completely, as shown in FIG. 6C. In this way, the locking arms 53 are pressed against the inclined surfaces 65 by the restoring force of the pair of side walls 29 of the lever 17 which are spaced away from each other. This pressing force is divided into a vertical reaction force from the inclined surfaces 65 which are received by the locking arms 53 and a component force in the sliding direction along the inclined surfaces 65. The component force constitutes an assisting force F which biases the lever 17 in the pushing direction.

Consequently, according to the lever type connector 11 of the embodiment, the locking arms 53 are provided on the lever 17, and the temporary locking releasing portions 63 are provided in the first housing 13. Then, when the locking arms 53 ride over the temporary locking releasing portions 63, the lever 17 is elastically deformed, and the elastic restoring force generated then can be made to contribute to the thrust force in the pushing direction of the lever 17. As a result, the lever type connector 11 can be obtained which is advantageous in reducing the size and weight and which can realize the reduction in inserting force.

Note that the lever type connector of the invention is not limited to the embodiment but can be modified or improved as required. In addition, the material, shape and dimensions of the lever type connector of the invention are arbitrary and are not limited to those described in the embodiment, provided that the object of the invention can be attained with them.

What is claimed is:

1. A lever type connector, comprising;

a first housing;

a second housing;

a lever, attached to the second housing, configured to be rotated to fit the first housing to the second housing in an operation direction, and having a pair of side walls and an operation portion connecting the side walls;

locking arms, provided on the side walls so as to project toward an opening of the first housing into which the second housing is fitted; and temporary locking releasing portions, provided in the first housing;

wherein the locking arms are deformed into a state that a part of each of the locking arms is disposed on each of the temporary locking releasing portions, so that the lever is elastically deformed, when the lever is rotated, wherein each of the temporary locking releasing portions has an inclined face, wherein each of the locking arms is moved when the lever is rotated in the operation direction from the state that the part of each of the locking arms is disposed on each of the temporary locking releasing portions, so that the lever is elastically restored after the locking arms are deformed by the temporary locking releasing portions and wherein the inclined face of each of the temporary lock releasing portions is configured such that during the restoring of the locking arms, the locking arms slide along the inclined face of each of the temporary lock releasing portions to generate an assisting force which urges the lever in the operation direction.

2. The lever type connector according to claim 1, further comprising:

temporary locking projections, provided in the second housing, wherein the locking arms are engaged to the temporary locking projections so that the lever is prevented from being rotated so as to be held at temporary locking positions.

3. The lever type connector according to claim 1, wherein the lock arms are deformed in a direction in which the pair of the side walls are spaced away from each other.

* * * * *